United States Patent [19]

Hamblett et al.

[11] Patent Number: 4,696,621

[45] Date of Patent: Sep. 29, 1987

[54] AEROFOIL SECTION MEMBERS FOR GAS TURBINE ENGINES

[75] Inventors: Martin Hamblett, Derby; Duncan J. Livsey, Burton-on-Trent, both of England

[73] Assignee: Rolls-Royce, London, England

[21] Appl. No.: 856,986

[22] Filed: Apr. 29, 1986

[30] Foreign Application Priority Data

Jun. 28, 1985 [GB] United Kingdom ..... 8516436

[51] Int. Cl.[4] ..... F04D 29/68

[52] U.S. Cl. ..... 415/191; 415/DIG. 1; 416/223 A; 416/242

[58] Field of Search ..... 415/DIG. 1, 119, 191, 415/192–195, 217, 218; 416/223 Q, 223 A, 235, 236, 237, 242, 243, DIG. 2

[56] References Cited

U.S. PATENT DOCUMENTS

| | | | |
|---|---|---|---|
| 2,746,672 | 5/1956 | Doll, Jr. et al. | 415/192 |
| 2,801,790 | 8/1957 | Doll, Jr. | 415/192 X |
| 2,920,864 | 1/1960 | Lee | 415/DIG. 1 |
| 3,193,185 | 7/1965 | Erwin et al. | 415/195 X |
| 3,572,962 | 3/1971 | Embleton et al. | 416/235 X |
| 3,745,629 | 7/1973 | Pask et al. | 415/195 X |
| 4,131,387 | 12/1978 | Kazin et al. | 415/119 |

FOREIGN PATENT DOCUMENTS

| | | | |
|---|---|---|---|
| 712589 | 7/1954 | United Kingdom | 416/223 A |
| 995685 | 6/1965 | United Kingdom . | |
| 2129882 | 5/1984 | United Kingdom . | |

*Primary Examiner*—Robert E. Garrett
*Assistant Examiner*—Joseph M. Pitko
*Attorney, Agent, or Firm*—Cushman, Darby & Cushman

[57] ABSTRACT

A gas turbine engine nozzle guide vane has "barrelled" shape, producing an "hourglass" shaped passage between adjacent vanes. These shapes promote radial pressure gradients which reduce secondary flaws in the motive gas passages.

4 Claims, 4 Drawing Figures

Fig. 1.
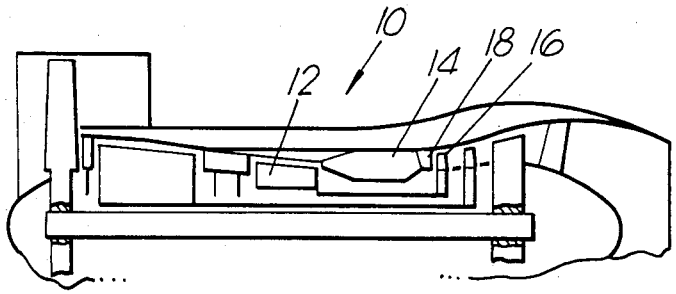
PRIOR ART Fig. 2.
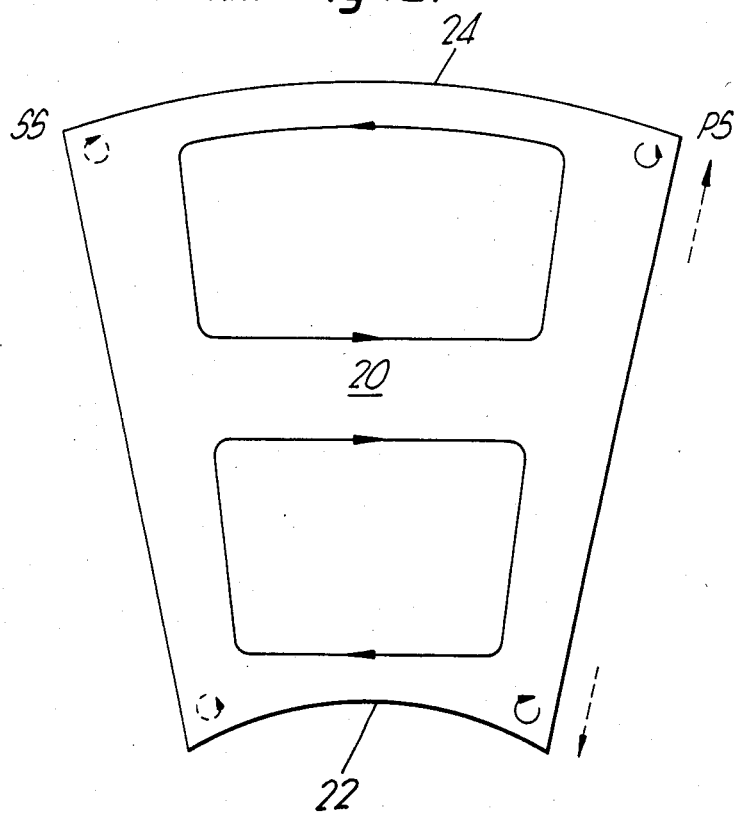

AEROFOIL SECTION MEMBERS FOR GAS TURBINE ENGINES

This invention relates to aerofoil section members for gas turbine engines. For example, the nozzle guide vanes which are located immediately downstream of the combustor of a gas turbine engine.

The function of these vanes is to receive the products of combustion from the combustor and to direct these products into the downstream high pressure turbine at the correct angle. In flowing through the passages defined by adjacent guide vanes and inner and outer circumferential end walls, and the flow is subject to aerodynamic losses, including losses due to secondary flows. For the purposes of this invention, secondary flows can be considered as flow having velocity vectors which differ substantially from the intended principal flow vectors of the motive gas.

The existence of these flows is well known, but there is uncertanity concerning the amount of loss generated by them, or the loss mechanism itself. It is believed that a cause of secondary flows is the movement of end wall boundary layers from the pressure surface to the suction surface of the vane under the influence of static pressure gradients in the circumferential direction. In many cases the flow in the circumferential direction is fed by pressure surface boundary layer fluid driven towards the end walls by radial, static pressure gradients on the pressure surface. The low energy fluid moves towards the suction surface corners where a loss generating core forms.

These secondary flows might be controlled in one or both of two ways. The onset of suction surface corner loss cores might be delayed by minimising or removing altogether the pressure surface radial pressure gradients, and the development of a loss core, once initiated, may be minimised.

The present invention has for an objective a reversal of the pressure surface radial pressure gradients, and a restriction of the growth of the suction surface corner loss cores by directing the suction surface boundary layer towards the endwalls. The vane design to meet this objective comprises a variation in the thickness of the vane at different spanwise locations, so that the vane tends to be thicker in the middle region and thinner at the ends. This has the effect of producing a barrel shaped vane and an hourglass shaped section passage between adjacent vanes.

Accordingly in its broadest sense, the present invention provides an aerofoil section member for a gas turbine engine, the member having a pressure surface comprising a concave flank, and a suction surface comprising a convex flank, both said flanks extending radially between the ends of the vane, the member being defined by a stack of elemental aerofoil shaped sections, the thickness of each elemental aerofoil section at locations between the ends of the member varying so that both the convex and concave flanks are convex in the spanwise direction along the member.

In some examples of a member according to the present invention, either or both of the flanks of the member may be parabolic in the spanwise direction.

The present invention will now be more particularly described with reference to the accompanying drawings in which, FIG. 1 is a diagrammatic half-elevation of a gas turbine engine to which the present invention can be applied.

FIG. 2 is a typical cross-section through a flow passage defined by a pair of adjacent "conventional" nozzle guide vanes.

Figure 3:
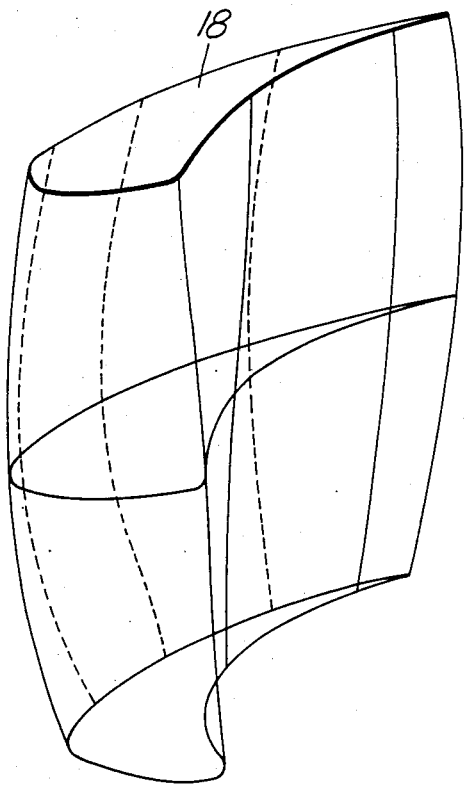
FIG. 3 is a perspective view of a nozzle guide vane according to the present invention.

Referring to FIG. 1, a gas turbine engine 10 of the high by-pass ratio front fan type, includes a high pressure system having a high pressure compressor 12, a combustion system 14, and a high pressure turbine 16 driving the compressor 12. The combustion system receives fuel and delivery air from the compressor 12, and the products of combustion are delivered to the high pressure compressor via an array of circumferentially spaced apart nozzle guide vanes 18. Adjacent guide vanes define passages 20 (FIG. 2 or 3) through which the high temperature, high velocity motive gases flow.

In FIG. 2 which discloses a prior art construction, the passage 20 is defined by the suction surface (SS) of one vane, the pressure surface (PS) of the adjacent vane, and inner and outer circumferential end walls 22, 24 respectively. The suction and pressure surfaces are both substantially radial in extent, and vortices known as passage vortices are formed in the central part of the passage, whilst vortices known as horse shoe vortices are formed in the corners of the passage. The solid arrows show the direction of the passage and horse shoe vortices, whilst the dotted arrows show the direction of the pressure gradients, in a decreasing sense.

The boundary layers on the end walls 22 and 24 respectively tend to move from the pressure surface to the suction surface under the influence of cross-passage pressure gradients. In many instances, the cross-passage flow is fed by pressure surface boundary layer fluid driven towards the end walls by radial pressure gradients on the pressure surface. The low energy fluid moves towards the suction surface corners where a loss making core forms.

The design of vanes according to the present invention aims to reverse the pressure surface radial pressure gradients and to restrict the growth of the suction surface pressure loss by directing the suction surface boundary layer towards the endwalls. It is considered that this latter flow will encourage vorticity in the suction surface corners in opposition to the dominant passage vorticity.

Figure 4:
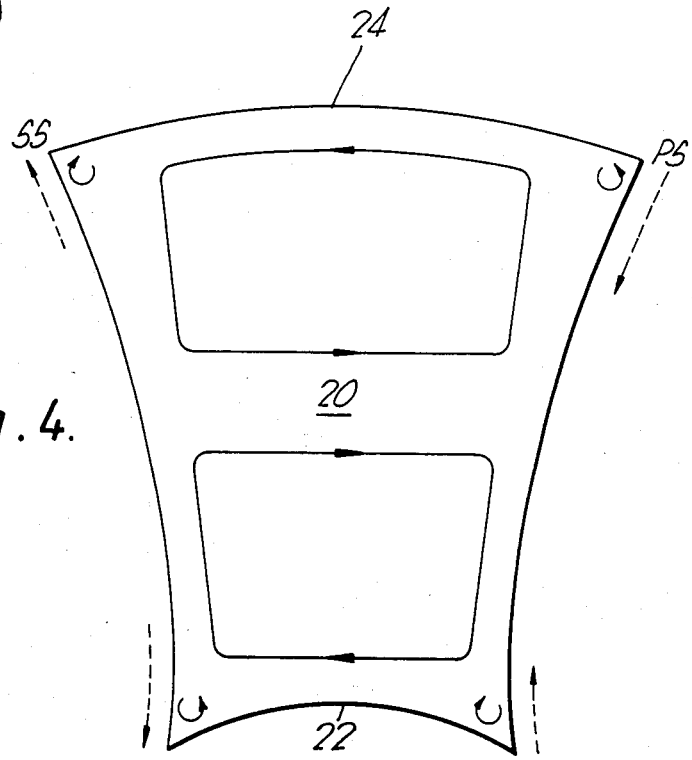
FIG. 4 is a cross-section through a flow passage defined by a pair of adjacent nozzle guide vanes, each of a design in accordance with the present invention.

A vane of the present invention designed to create these conditions is shown in FIG. 3, and the passage shape 20 formed by an adjacent pair of such vanes is shown in FIG. 4. It will be seen that the pressure surface radial pressure gradient has been reversed, as compared to that shown in FIG. 2, and that on the suction surface, the boundary layer is encouraged to flow towards the end walls 22, 24 by the radial pressure gradients on that surface.

From FIG. 3, it will be noted that this design approach produces a vane having a "barrelled" shape, and consequently a passage having an "hourglass" shape. It may be necessary, in order to obtain the required pressure surface shape to use a small degree of compound lean. This compound lean may vary as between the inner and outer end walls, and the conditions for throat orthogonality should not be compromised to any great extent.

The three diminsional shape of the vane and thus the passage between adjacent vanes will vary according to the application. In all cases, the vane will be thicker in the middle to produce the "barrelled" shape, the pressure and suction surface flanks may follow a variety of shapes or curves in the radial sense, e.g., parabolic.

Whilst the invention has been described in relation to a nozzle guide vane for a gas turbine, it can be applied to any array of vanes.

We claim:

1. An aerofoil section member for a gas turbine engine the member having a pressure surface comprising a concave flank and a suction surface comprising a convex flank, both said flanks extending radially between the ends of the member, the member being defined by a stack of elemental aerofoil shaped sections, the thickness of each elemental aerofoil section at locations between the ends of the member varying so that both the convex and concave flanks are convex in the spanwise direction along the member.

2. An aerofoil section member as claimed in claim 1 in which at least one of said flanks is parabolic.

3. An aerofoil section member as claimed in claim 1 or claim 2 in the form of a gas turbine engine nozzle guide vane.

4. A nozzle guide vane assembly for a gas turbine engine comprising:

a plurality of circumferentially spaced airfoil section members, adjacent ones of said airfoil section members defining a passage for the flow of gases therethrough, each of said airfoil section members having a pressure surface comprising a concave flank and a suction surface comprising a convex flank, both of said concave and convex flanks of each of said airfoil section members extending radially between ends of each of said airfoil section members, each of said airfoil section members being defined by a stack of elemental airfoil shaped sections, a thickness of each of said elemental airfoil sections at locations between the ends of each of said airfoil section members varying so that both said convex and said concave flanks are convex in a spanwise direction, and said passage between adjacent ones of said airfoil section members having an hour glass shape.

* * * * *